United States Patent [19]

Woog

[11] Patent Number: 5,057,858

[45] Date of Patent: Oct. 15, 1991

[54] DEVELOPER RECYCLER IN CONNECTION WITH PHOTO PROCESSING MACHINE

[76] Inventor: Gunter Woog, 5435 Bauers Dr., West Bend, Wis. 53095

[21] Appl. No.: 617,522

[22] Filed: Nov. 23, 1990

[51] Int. Cl.[5] ..... G03D 3/06

[52] U.S. Cl. ..... 354/324; 137/563

[58] Field of Search ..... 354/320, 321, 322, 324, 354/325; 137/563, 565

[56] References Cited

U.S. PATENT DOCUMENTS

| | | | |
|---|---|---|---|
| 3,990,088 | 11/1976 | Takita | 354/324 X |
| 4,506,986 | 3/1985 | Freeman | 137/563 X |
| 4,577,950 | 3/1986 | Mackson | 354/324 |
| 4,650,339 | 3/1987 | Chetcuti et al. | 137/563 X |
| 4,804,452 | 2/1989 | Rhodes . | |

*Primary Examiner*—A. A. Mathews

*Attorney, Agent, or Firm*—Fuller, Ryan & Hohenfeldt

[57] ABSTRACT

A device for recycling developer into a photo processing machine. The device includes a container for containing developer coming out of the developer overflow outlet of the photo processing machine. The developer enters via an inlet into the container, connected to the developer overflow outlet, and positioned so as to minimize agitation. The container has at least one overflow outlet therein, positioned so as to permit the outflow of developer from the container when the level of the developer reaches a predetermined level in the container. A pump transfers the developer from the container into the automixer developer tank. This pump is energized by the same control that controls the introduction of fresh developer and water into the automixer developer tank. A level switch is provided for shutting off the pump when there has been a predetermined amount of developer pumped from the container into the automixer developer tank.

6 Claims, 1 Drawing Sheet

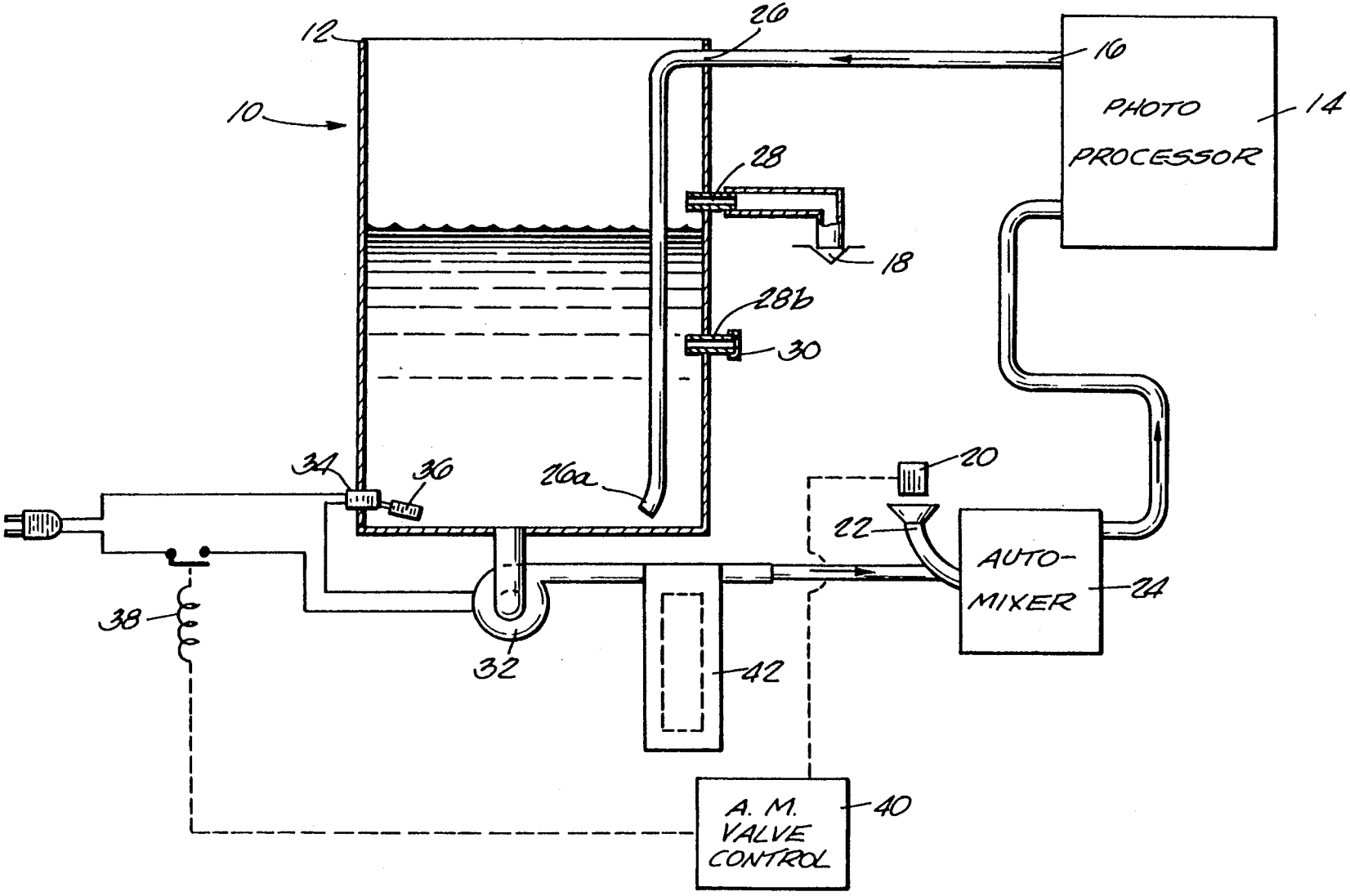
14
PHOTO PROCESSOR
16
24
AUTO-MIXER
20
22
18
40
A. M. VALVE CONTROL
26
28
28b
30
42
26a
32
36
34
12
10
38

DEVELOPER RECYCLER IN CONNECTION WITH PHOTO PROCESSING MACHINE

BACKGROUND OF THE INVENTION

This invention relates to photo processing machines, and in particular to apparatus for automating the recycling of developer in such machines.

To date, it has been difficult and expensive to reuse and recycle developer. There are those who believe that it is merely necessary to cut back the replenisher rate for each film. For instance, if the normal rate is 100 cc, the recycling could be accomplished by reducing it to 50 cc. The problem with that approach, however, is that it does not account for the buildup of certain salts that can act to inhibit the development process. The only way to avoid such a buildup is to redilute the used developer with new developer.

The only method for doing so to date has been practiced only in large photo finishing plants and large hospitals, both of which have central mixing facilities. In those cases an operator could isolate several hundred gallons of used developer and reintroduce that developer into several hundred more gallons of new developer. This process is expensive even for such large companies because of the labor-intensive nature of the work, and is simply unavailable for smaller companies.

This invention relates to improvements to the methods and apparatus described above and to solutions to the problems raised or not solved thereby.

SUMMARY OF THE INVENTION

The invention relates to a device for recycling developer into a photo processing machine. Generally, a photo processing machine has at least a developer overflow outlet and an automixer. The automixer has an automixer developer tank for mixing photographic chemicals and inputting them into the photo processing machine. According to the invention, the recycling device includes a container for containing developer coming out of the developer overflow outlet of the photo processing machine. This developer enters via an inlet into the container, connected to the developer overflow outlet. The container has at least one overflow outlet therein, positioned so as to permit the outflow of developer from the container when the level of the developer reaches a predetermined level in the container. The invention further calls for a pump for pumping the developer from the container into the automixer developer tank. This pump is energized by the same control that controls the solenoid valve introducing fresh developer into the automixer developer tank. Means are provided for shutting off the pump when there has been a predetermined amount of developer pumped from the container into the automixer developer tank. Additional overflow outlets may be provided, positioned at different levels than the overflow outlet first referred to above. These additional overflow outlets permit the operator to selectively permit the outflow of developer from the container when the level of the developer reaches a different the respective different levels. A filter on the order of 5 to 10 microns may be positioned in line between the pump and the automixer developer tank, for filtering out solids in the recycled developer. Preferably the inlet into the container is positioned at the bottom of the container so as to reduce agitation of the developer on introduction.

Other objects and advantages of the invention will become apparent hereinafter.

DESCRIPTION OF THE DRAWING

The drawing FIGURE is a side cross-sectional view, partially schematic, of an apparatus constructed according to a preferred embodiment of the invention.

DESCRIPTION OF THE PREFERRED EMBODIMENTS

Referring now to the drawing FIGURE, it can be seen that the recycling apparatus 10 shown there, constructed according to a preferred embodiment of the invention, includes a container 12. It is irrelevant whether the top of the container 12 is open or not.

In a conventional photo processing system, a photo processing machine 14 has a developer overflow outlet 16, which is normally connected to a drain 18 or possibly some silver reclamation device, not shown, which is in turn connected to the drain. In such a conventional system, the fresh photo developer chemicals and water are introduced, by opening solenoid valve 20, into the chemical inlet 22 of an automixer 24, which mixes the chemicals before passing them into the photo processing machine 14.

This system, however, results in substantial waste of developer. Hence the present invention is provided to avoid this waste. To that end, a container inlet 26 is provided to the container 12. This container inlet 26 is connected to the overflow outlet 16 of the processing machine. Because it can be detrimental to certain of the chemicals contained in the developer, the container inlet 26 is constructed to minimize agitation of the developer upon introduction of the developer into the container. Hence the outlet **26*a* of the container inlet 26** is positioned as near to the bottom of the container as possible.

The invention also calls for an overflow outlet 28, which is connected to the drain 18. The position of the overflow outlet 28 in effect determines the amount of developer that will be recycled. In order to give control of this level to the operator of the apparatus 10, in one embodiment several overflow outlets may be provided. In the embodiment shown in the drawing figure overflow outlet 28 acts as an upper overflow and a lower overflow **28*b* is also provided. Clearly, any overflow below the one intended to be used must be capped, such as by a cap 30, shown attached over lower overflow 28*b*. Thus as developer flows out of the photo processor 14, the container 12 fills, up to the level of the container overflow 28**, after which time the developer overflows to the drain or other disposal means.

Then, when it is time to add new developer into the automixer 24, those chemicals are added via the chemical inlet 22 to the automixer, and the automixer is activated. At the same time, the developer in the container 12 is pumped into the automixer 24, by means of a pump 32. As shown in the drawing FIGURE, the pump 32 has an inlet at the bottom of the container 12. In order to prevent the pump 32 from running dry, the preferred embodiment of the invention includes a liquid level switch 34, having a float 36 positioned inside the container 12, near the bottom thereof. Thus when the level of the developer in the container 12 is reduced to the level of the switch 34, the switch opens and de-energizes the pump 32.

In one embodiment, in order to facilitate the use of the apparatus 10, the pump 32 is energized by a relay 38 controlled by the same control 40 that controls the fresh developer solenoid valve 20. Then whenever the fresh developer solenoid 20 is opened, the pump 32 is also energized, to pump recycling developer from the container 12 into the automixer 24.

In order to ensure that any solid or precipitated portions of developer are removed, the invention may provide that the apparatus 10 includes a filter 42, in the line between the developer recycling pump 32 and the automixer 24. Preferably this filter will be on the order of a 5 to 10 micron filter, to properly catch the precipitates and still permit the free passage of the developer.

While the apparatus hereinbefore described is effectively adapted to fulfill the aforesaid objects, it is to be understood that the invention is not intended to be limited to the specific preferred embodiment of developer recycler in connection with photo processing machine set forth above. Rather, it is to be taken as including all reasonable equivalents within the scope of the following claims.

I claim:

1. A device for recycling developer into a photo processing machine, said photo processing machine having a developer overflow outlet and an automixer, having an automixer developer tank, for mixing photographic chemicals and inputting them into the photo processing machine, said device comprising:

a container for containing developer;

an inlet into said container, connected to the developer overflow outlet, for permitting developer to flow from the developer overflow outlet into said container;

said container having at least one overflow outlet therein, positioned so as to permit the outflow of developer from said container when the level of the developer reaches a predetermined level in the container;

a pump for pumping the developer from the container into the automixer developer tank, said pump being energized by the same control that controls pumping of fresh developer into the automixer developer tank; and means for shutting off the pump when there has been a predetermined amount of developer pumped from the container into the automixer developer tank.

2. A device for recycling developer as recited in claim 1 further comprising at least one additional overflow outlet, positioned at a different level than said at least one overflow outlet, for permitting the outflow of developer from said container when the level of the developer reaches a different level.

3. A device for recycling developer as recited in claim 1 further comprising a filter, positioned in line between the pump and the automixer developer tank, for filtering out solids in the recycled developer.

4. A device for recycling developer as recited in claim 3 wherein said filter is on the order of 5 to 10 microns.

5. A device for recycling developer as recited in claim 1 wherein said inlet into said container is positioned at the bottom of said container so as to reduce agitation of the developer already in the container with the introduction of developer into the container.

6. A device for recycling developer as recited in claim 1 wherein said pump connects to said container by means of a pump inlet, said pump inlet being positioned at the bottom of the container.

* * * * *